United States Patent [19]

Queener

[11] 4,179,213

[45] Dec. 18, 1979

[54] VECTOR PINNING IN AN ELECTROPHOTOGRAPHIC MACHINE

[75] Inventor: Carl A. Queener, Longmont, Colo.

[73] Assignee: International Business Machines Corporation, Armonk, N.Y.

[21] Appl. No.: 894,954

[22] Filed: Apr. 10, 1978

[51] Int. Cl.[2] ..... G03G 15/00

[52] U.S. Cl. ..... 355/14 R; 118/665; 118/708; 356/448; 427/10; 430/30

[58] Field of Search ..... 355/3 R, 14, 77, 133; 118/7, 646; 427/10; 96/1 R; 356/448; 250/559

[56] References Cited

U.S. PATENT DOCUMENTS

| | | | |
|---|---|---|---|
| 2,956,487 | 10/1960 | Giaimo | 355/14 |
| 3,094,049 | 6/1963 | Snelling | 355/3 DD |
| 3,348,521 | 10/1967 | Hawk | 118/7 |
| 3,348,522 | 10/1967 | Donohue | 118/7 |
| 3,348,523 | 10/1967 | Davidson et al. | 118/7 |
| 3,354,802 | 11/1967 | Doucette et al. | 355/10 |
| 3,611,982 | 10/1971 | Coriale et al. | 118/4 |
| 3,640,615 | 2/1972 | Schaeffer | 355/8 |
| 3,647,293 | 3/1972 | Queener | 355/15 |
| 3,647,295 | 3/1972 | Dobouney | 355/38 |
| 3,700,323 | 10/1972 | Guyette et al. | 355/14 X |
| 3,719,165 | 3/1973 | Trachienberg et al. | 118/7 |
| 3,719,169 | 3/1973 | Cade et al. | 118/636 |
| 3,724,942 | 4/1973 | Gibson et al. | 355/3 |
| 3,778,146 | 12/1973 | Knapp | 355/3 |
| 3,783,818 | 1/1974 | Makino et al. | 118/4 |
| 3,801,196 | 4/1974 | Knapp et al. | 355/3 |
| 3,834,807 | 9/1974 | Fuller et al. | 355/3 R |
| 3,850,662 | 11/1974 | Jahn | 355/3 R X |
| 3,893,414 | 7/1975 | Hudson | 118/637 |
| 3,901,593 | 8/1975 | Kogiso et al. | 355/11 |
| 3,911,861 | 10/1975 | Griesmer | 118/7 |
| 3,911,865 | 10/1975 | Volkers | 118/637 |
| 3,914,045 | 10/1975 | Namiki et al. | 355/15 |
| 3,926,338 | 12/1975 | Reyner | 222/56 |
| 3,927,641 | 12/1975 | Handa | 118/637 |
| 3,928,764 | 12/1975 | Bock et al. | 250/272 |
| 4,026,643 | 5/1977 | Bergman | 355/14 X |
| 4,082,445 | 4/1978 | Steiner | 355/14 |

OTHER PUBLICATIONS

Boggs et al, "Toner Feed Control System", IBM Technical Disclosure Bulletin, vol. 15, No. 4, Sep. 1972, pp. 1258 and 1259.

Smith, G. L., "Toner Concentration Control", IBM Technical Disclosure Bulletin, vol. 19, No. 11, Apr. 1977, pp. 4078 and 4079.

*Primary Examiner*—Fred L. Braun

*Attorney, Agent, or Firm*—Charles E. Rohrer

[57] ABSTRACT

Apparatus and method for pinning the value of a white, gray or otherwise colored, single-shaded vector in an electrophotographic machine. The vector is the value of the image voltage minus the developer voltage. Valuation of changes in the image voltage are obtained by (1) sensing the reflectivity of a developed single-shaded image and converting that into a representative voltage; (2) sensing the reflectivity of the bare photoconductor and converting that into a representative voltage; (3) obtaining a comparison of the representative image and reference voltages; and (4) noting changes in the comparison. Pinning the vector calls for adjusting the member for producing the vector such as the developer voltage or document illumination intensity level an amount necessary to compensate for the change in image voltage.

15 Claims, 9 Drawing Figures

| LEGEND | |
|---|---|
| 0 | ON |
| X | OFF |

VECTOR PINNING IN AN ELECTROPHOTOGRAPHIC MACHINE

This invention relates to the improvement of copy quality in an electrophotographic machine and more particularly to a system for optimizing the color intensity and background of copies.

RELATED PATENT APPLICATIONS

U.S. patent application Ser. No. 894,956 describes a test cycle which may be used to advantage for quality control; U.S. patent application Ser. No. 894,955 relates to a method, circuit and apparatus which may be advantageously used in quality control; and U.S. patent application Ser. No. 894,957 relates to a specific quality control. All of these patent applications were filed on even date herewith.

BACKGROUND OF THE INVENTION

In document copier machines of the electrophotographic type charged latent images are produced on a photoreceptive material and then developed through the application of a developer mix. Where the photoreceptive material is separate from the copy paper itself, a transfer of the developed image to the copy paper takes place with subsequent fusing of the developed image to the paper. A common type of developer mix currently in use in such machines is comprised of a carrier material, such as a magnetic bead, coated with a colored powdery substance called toner. It is the toner which is attracted to the charged, latent image to develop that image and it is the toner which is then transferred from the latent image to the copy paper (where the copy paper is separate from the photoreceptive material). Finally it is the toner which is then fused to the copy paper to produce the finished copy.

It is apparent from the procedure outlined above that toner is a supply item which must be periodically replenished in the developer mix since the toner is carried out of the machine on the copy paper as a reproduced image. It is also apparent that the concentration of toner particles in the developer mix is significant to good development of the latent image since too light a toner concentration will result in too light a developed image and too heavy a toner concentration will result in too dark a developed image.

Literally hundreds of schemes have been developed for maintaining the concentration of toner in a developer mix. The related patent applications, named above, describe one of the best toner concentration control schemes known to the inventor.

Whatever the method of toner concentration control chosen for use in a particular apparatus there remain other variables which seriously affect copy quality. Basically, the density of the development of a toned solid xerographic image is a function of three variables: (1) toner concentration; (2) the image voltage of the photoconductor; and (3) bias voltage on the developer. As discussed above, there are many schemes for controlling toner density.

In the xerographic process the photoconductor is charged to a uniform level at an elevated voltage. The photoconductor is then subjected to illumination to dissipate the charge on the photoconductive surface. The illumination is generally reflected off the surface of a document to be copied such that the white areas of the document to be copied reflect a large amount of illumination and discharge the photoconductor to a low level, whereas the colored areas reflect a low level of light and consequently leave a relatively high charge on the photoconductor. Shades of grayness discharge the photoconductor to varying charge levels. In that manner the photoconductor is made to bear the latent image of the original document. Thus, the variable named above, "image voltage on the photoconductor," is generic to a so-called "white voltage" representative of the areas on the photoconductor which have been discharged by reflected illumination from a white portion of the document to be copied; a "black voltage" which is produced at the relatively undischarged areas of the photoconductor representative of black portions of the original document to be copied; and various "gray voltages" representative of variously colored or shaded areas of the original document.

Once the charged latent image is produced on the photoconductor the image is then subjected to a development technique wherein a colored powdery material called toner is placed upon the latent image. At the development area a development voltage is applied in order to produce a uniform toner distribution in the solid black and solid colored or gray areas of the latent image. In magnetic-brush type developers this is often accomplished by applying a bias voltage directly to the magnetic brush. Regardless of the type of developer used, a quantity termed the "white vector" can be defined which is the absolute value of the white voltage minus the bias (development) voltage; a "black vector" can be defined which is the absolute value of the black voltage minus the bias voltage; a gray vector can be defined for a particular shade of gray which is the absolute value of the gray voltage minus the bias voltage; and any single color vector which is the absolute value of the single color voltage minus the bias voltage.

The inventor herein notes that two of the three variables defining the density of toned solid xerographic images are contained in the definitions of the white vector, black vector and gray vector, i.e., the voltage on the photoconductor and the bias voltage on the developer. Therefore, the inventor reasoned, if we are able to control toner concentration and pin the vector, i.e., control the value of, for example, the white vector, all of the three major variables which go into the development of a solid xerographic image have been controlled or at least balanced. As a result, repeatable high quality images over the life of a photoconductor can be reasonably assured even though the surface characteristics and electrostatic quality of the photoconductor change with age and use; even though there is a tendency for toner to film the photoconductor with use; and even though Teflon, if used in the system, tends to film the photoconductor. This reasoning is equally applicable to a range of color images, for example, magenta.

SUMMARY OF THE INVENTION

This invention involves a vector pinning method and apparatus in which a white, gray or otherwise shaded or colored developed image test area is produced, and the reflectivity of that test area is sampled and converted into a representative voltage. That voltage is compared to a reference voltage which is obtained by viewing the reflectivity of a cleaned area of the photoconductor. (By repetitive testing, changes in the comparison of the reference voltage and the representative image voltage level can be sensed.) In that manner, an accurate measure of changes in the photoconductor image voltage is determined which is independent of many variables including the temperature and the age of the photoconductor. Once an accurate representation of changes in the photoconductor image voltage has been obtained an accurate determination of the corresponding representative vector is calculated by obtaining the value of the representative image voltage minus the bias voltage. Thus, if the image voltage level changes over a period of time the bias voltage can be changed to return the vector to its original value, or, if desired, the image voltage itself can be adjusted to return to the original vector value by adjusting the amount of illumination supplied by the document lamp or any other apparatus factoring into production of the image voltage. By pinning the vector in this manner and by previously controlling the toner concentration, all major variables going into quality reproductions have been controlled.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION a. In General

Figure 1:
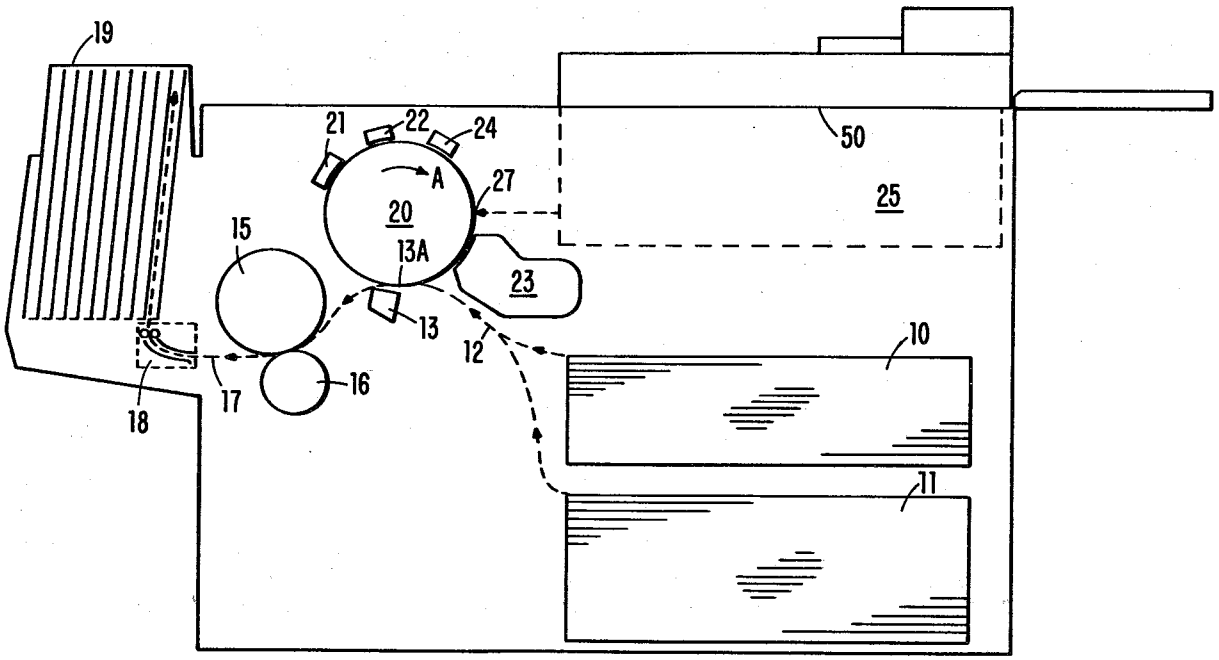
FIG. 1 shows a schematic layout of an electrophotographic machine utilizing the instant invention.

FIG. 1 shows a typical electrophotographic machine of the transfer type. Copy paper is fed from either paper bin 10 or paper bin 11 along guides 12 in the paper path to a transfer station 13A located just above transfer corona 13. At that station an image is placed upon the copy paper. The copy paper continues through the fusing rolls 15 and 16 where the image is firmly attached to the copy paper. The paper continues along path 17 into a movable deflector 18 and from there into one of the collator bins 19.

In order to produce an image on the photoconductive surface 26 a document to be copied is placed upon a glass platen 50. An image of that document is transferred to the photoconductive surface 26 through an optics module 25 producing that image on the photoconductive surface 26 at exposure station 27. As the drum 20 continues to rotate in the direction A developer 23 develops the image which is then transferred to the copy paper. As the photoconductor continues to rotate it comes under the influence of preclean corona 22 and erase lamp 24 which discharge all of the remaining charged areas on the photoconductor. The photoconductor continues to pass around and through the developing station 23 (which is also a cleaning station in this embodiment) until it reaches the charge corona 21 where the photoconductor 26 is again charged prior to receiving another image at exposure station 27.

Figure 2:
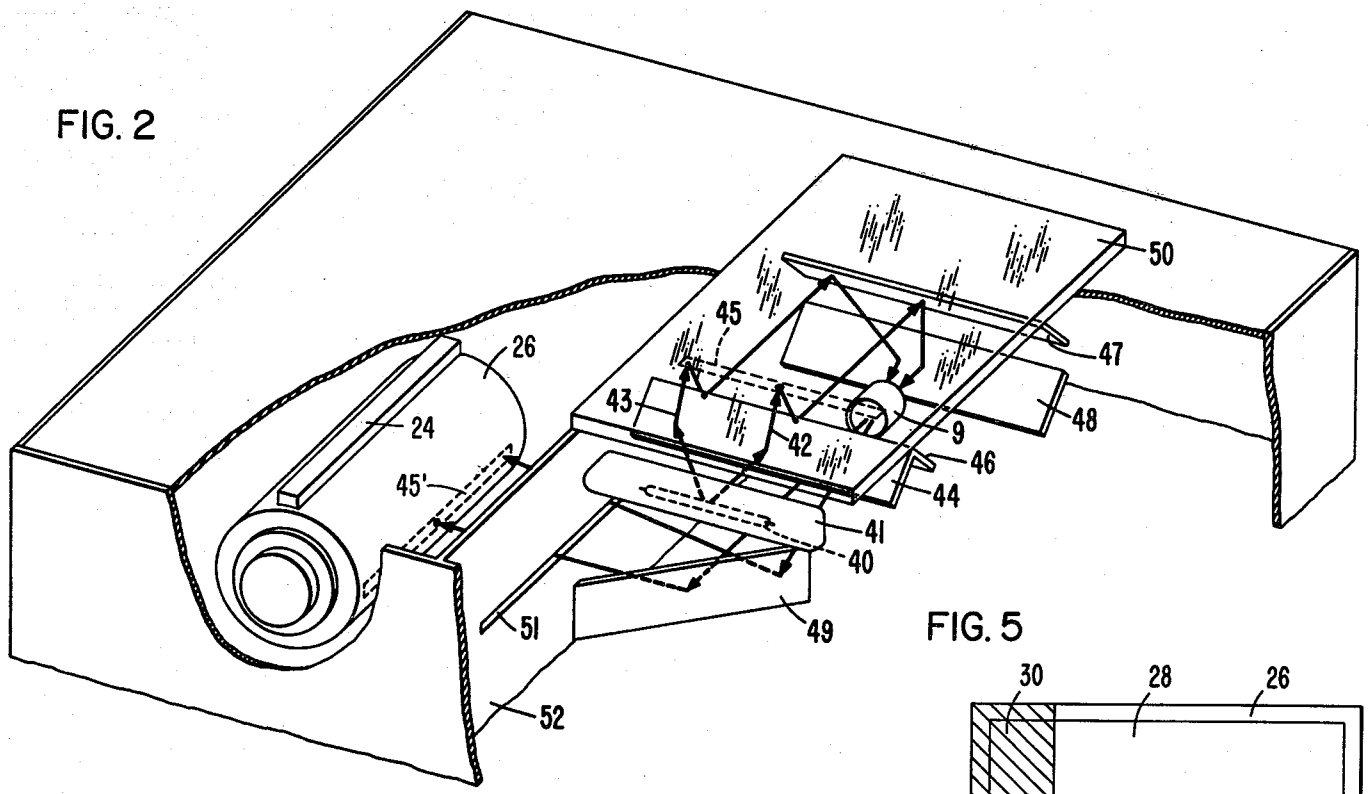
FIG. 2 shows the optical system and a photoconductive drum in the machine of FIG. 1.

FIG. 2 is a perspective of the optics system showing the document glass 50 upon which the document to be copied is placed. An illumination lamp 40 is housed in a reflector 41. Sample light rays 42 and 43 emanate from lamp 40 and are directed from dichroic mirror 44 to the document glass 50 whereat a line of light 45 is produced. Sample light rays 42 and 43 are reflected from the document placed on the document glass to reflective surface 46, from there to reflective surface 47 to reflective surface 48 and thence through lens 9 to another reflective surface 49. From mirror 49 the light rays are finally reflected through opening 51 in wall 52 to reach photoconductor 26 whereat a line of light 45' is produced. In that manner a replica of the information contained in the line of light 45 on the glass platen 50 is produced on the photoconductor 26 at 45'. The entire length of a document placed on document glass 50 is scanned by motion of lamp 40 and the mirrors 44, 46, 47 and 48. By traversing the line of light 45 across the document at the same speed at which the line of light 45' is moved across photoconductor 26 by rotation of drum 20, a 1:1 copy of the document can be produced on the photoconductor 26.

Figures 3, 4:
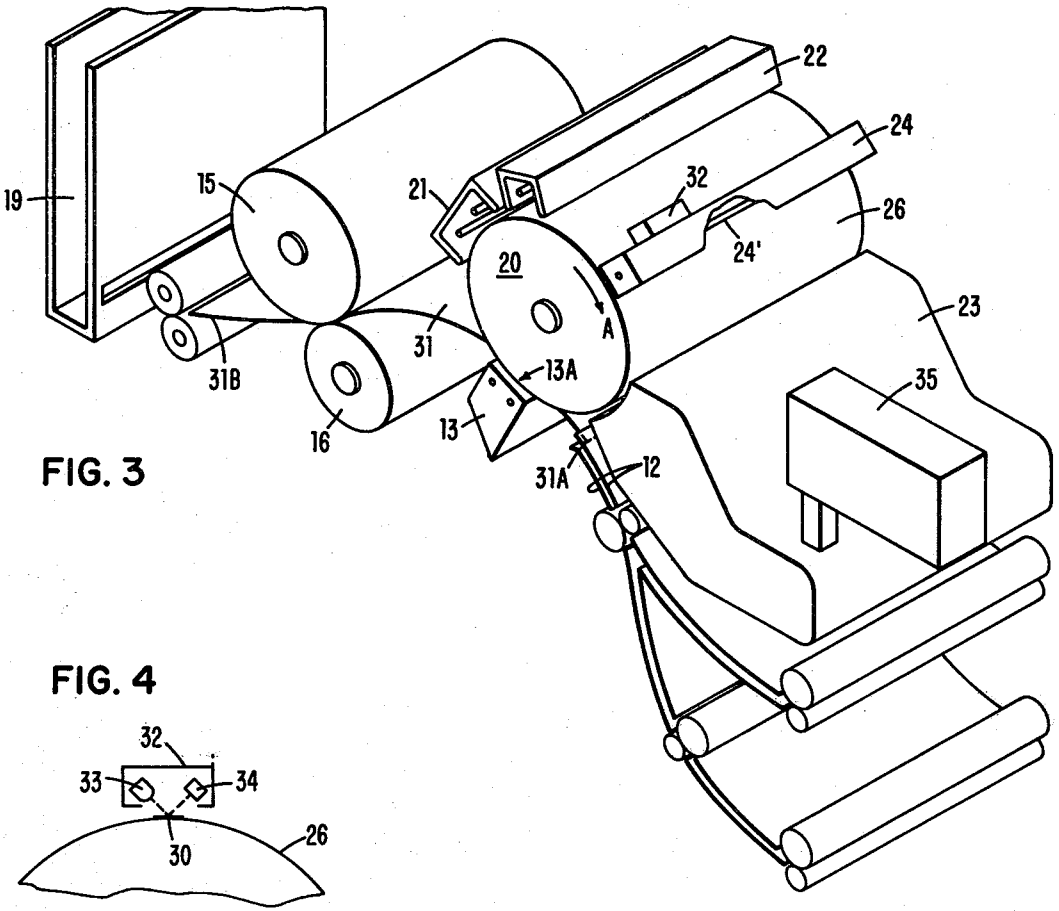
FIG. 3 is an idealized perspective view of components in the paper path of the machine.
FIG. 4 shows the reflectivity-sensing elements of the toner concentration control device.

FIG. 3 shows the various elements in the paper path in perspective. Here a copy sheet 31 is shown with its trailing edge 31A in the paper path at guides 12. The copy paper is receiving an image at transfer station 13A and is in the process of having that image fused to itself by fuser rolls 15 and 16. The leading edge 31B of the copy paper is about to leave the document copier and proceed into the collator 19 which is represented in simplified form.

After an image is transferred to the copy paper, the photoconductor 26 continues to rotate until it comes under the influence of preclean corona 22 which applies a charge to the photoconductive surface to neutralize the remaining charge thereon. Photoconductor 26 continues to rotate until the photoconductor comes under the influence of an erase light 24' in housing 24. The erase light produces illumination across the entirety of the photoconductor 26 in order to complete the discharge of any remaining areas on the photoconductive surface which have not been neutralized by the preclean corona 22. After passing under erase lamp 24', the photoconductor continues through the cleaning station of developer/cleaner 23, wherein any remaining toner powder not transferred to copy paper is cleaned from the photoconductor prior to the beginning of the next copy cycle.

In the next copy cycle the charge corona 21 lays down a uniform charge across photoconductor 26 which charge is variably removed when the image of the document is placed on the photoconductor at the exposure station 27 shown in FIG. 1. Preclean corona 22 and erase lamp 24' are off during this cycle.

When a toner concentration control cycle is run, and if the result indicates a need to add toner to the developer, a signal is sent to replenisher 35 which holds a supply of toner and operates to dump a measured amount into the developer. In that manner, the toner density of the developer mix is replenished. Any suitable replenisher mechanism may be used including the replenisher described in *IBM Technical Disclosure Bulletin,* Vol. 17, No. 12, pp. 3516, 3517.

b. The Test Cycle

Figure 6:
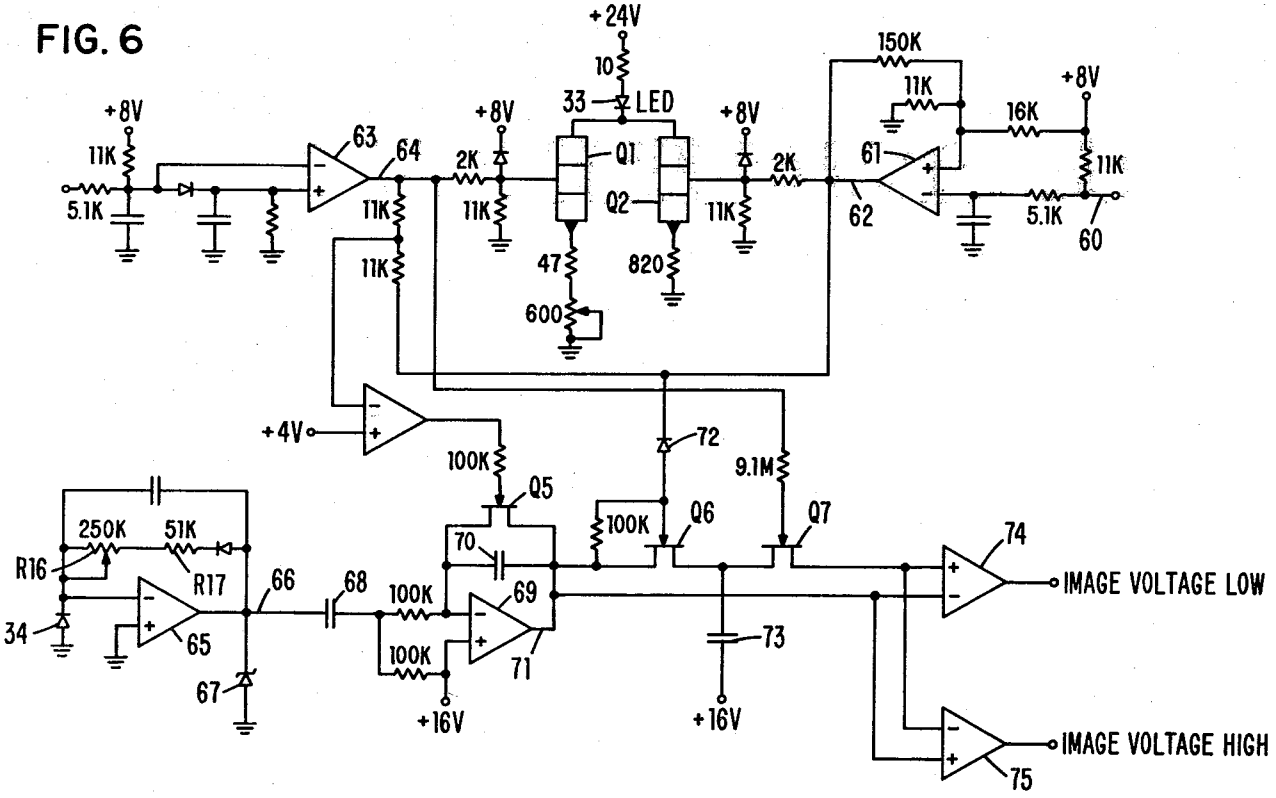
FIG. 6 shows the circuit for processing the reference and test information.

FIG. 3 shows a housing 32 containing the photoconductor voltage sensing system shown in FIGS. 4 and 6. When it is desired to sense for an image voltage, such as the white or gray voltage, the photoconductor is charged as usual at the charge corona 21. On this pinning control test cycle, however, the erase lamp 24' remains on discharging all of the charge which has been laid down by charge corona 21, except for a charged stripe which is produced by momentarily interrupting the light from lamp 24'. If the lamp 24' is comprised of an array of light-emitting diodes, the array can be segmented such that only a few of the LEDs are momentarily turned off and therefore only a small "patch" of charge remains on the photoconductor at the conclusion of this part of the cycle. If a fluorescent tube is used as the erase lamp 24', momentarily reducing its energization to a low level will produce a "stripe" of charge on the photoconductor at the conclusion of this part of the cycle.

Whether a stripe of charge or a patch of charge is produced, the charged test area continues to rotate in the direction A until it reaches the exposure station 27 whereat it is discharged by illumination from document lamp 40 reflected from a white, gray or otherwise colored surface near or on the glass platen 50. In that manner, an imaged test area is produced on photoconductor 26.

Next, the test area rotates to developer 23 where toner is placed onto the imaged area to produce a toned white, gray, magenta, etc., sample test area (for simplicity, hereafter the test area will be called "white" but that term should be understood as including gray and other colors). No copy paper need be present at transfer station 13A in the white vector control cycle, thus allowing the developed test area to continue its rotation in direction A until it approaches the control housing 32. At this point, referring now to FIG. 4, a light-emitting diode (LED) or other suitable light source 33 is energized to produce light rays which reflect off the toned white sample test area 30 and are reflected to a photosensor 34.

Figure 5:
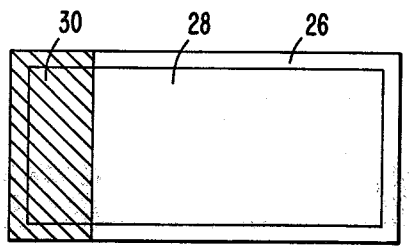
FIG. 5 shows the layout of the photoconductor with the location of the bare reference area and the developed test area within the document reproduction image area.

FIG. 5 shows the layout of photoconductor 26 with an image area 28 shown therein. The white sample test area 30 is shown encompassing a portion of image area 28. Test area 30 can be produced by instructing the operator to place a piece of white paper on document glass 50 during the test cycle. The same result can be achieved automatically by mechanically moving a white surface directly under a portion of the document glass 50 during the test cycle. Similarly, various colors can be moved onto or under the document glass for setting various vectors.

Figure 7:
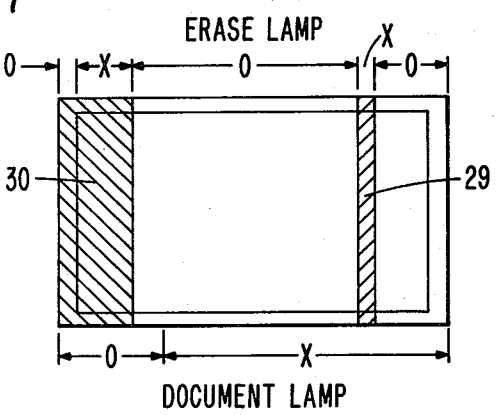

It should be noted that toner concentration density should be tested before the vector test in order to ensure a proper level of toner density before the vector test is undertaken. While any suitable toner concentration control test method can be used, FIG. 7 shows a layout of the photoconductor 26 with a toner concentration test area 29 in addition to vector test area 30. In this instance, test area 29 is produced and tested according to the technique of the related patent applications, named above, and incorporated herein by reference. Thus, both toner concentration and vector testing can be performed on the same test cycle. The test cycle may be performed during a run-out cycle on short runs but it may be necessary to periodically skip a copy during long, multi-copy runs in order to provide the test cycle.

The manner of producing FIG. 7 is shown on the drawing by momentarily turning off erase lamp 24' to obtain stripe 29 for toner concentration testing and again turning it off for the vector test area 30. Document lamp 40 would be turned on at any point between stripe 29 and vector area 30.

Figure 8:
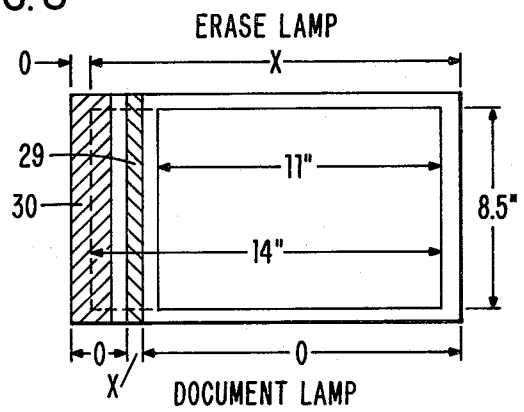
FIGS. 7 and 8 show simplified lamp timing charts relative to a layout of the photoconductor.

A test cycle which skips copies can be avoided during the production of small size copies, if desired. For example, if 8.5×11-inch copies are being produced on a photoconductor capable of producing 14-inch copies, the extra 3-inch image area can be used for toner concentration and vector testing without the need for a special cycle. Obviously, a mechanically moving surface under the document glass is needed for the production of the vector test area. FIG. 8 shows a layout of the photoconductor for this operation. Also, FIG. 8 shows the on/off operation of the erase lamp 24' and the document lamp 40 in order to produce test areas during a cycle in which 8.5×11-inch copies are being simultaneously produced.

c. The Circuit—FIG. 6

In order to produce a reference voltage, when the proper time in the sequential operation of the machine has arrived, the logic control of the machine provides a signal to trigger the viewing of a reference sample. This is accomplished by energizing LED 33 in the following manner. The logic signal results in triggering a transistor switch (not shown) which connects the reference sample input line 60 to ground. As a consequence, the voltage on the negative input of OP AMP 61 is dropped from approximately 8 volts to about ground potential. This causes the negative input of OP AMP 61 to switch from a value higher than the positive input to one that is lower resulting in an inversion of OP AMP output from low to high on line 62. That output is then fed back to the positive input to lock the OP AMP 61 in a high output condition avoiding oscillations. The output voltage on line 62 is applied to transistor Q2 to turn that transistor on, thus closing a circuit from the 24-volt source through the light-emitting diode 33 and transistor Q2 to ground. The result is to provide light from the LED 33 to the photocell 34 at the precise time in the machine cycle to reflect light rays from the bare photoconductor to photocell 34.

In order to produce a sensed white voltage, when the proper time in the machine cycle is reached to direct light upon the white voltage sample, a logic signal is provided to turn on a transistor switch, not shown, to connect the white voltage sample input line to ground. This results in lowering the negative input on OP AMP 63 from approximately 8 volts to ground potential and causes the output on line 64 to go high. The signal on line 64 turns on the transistor Q1, causing the light-emitting diode to conduct through the transistor Q1 to ground. Note that the resistance levels connected with the transistor Q1 are significantly lower than the resistances associated with transistor Q2. As a result, the current level through transistor Q1 is significantly higher than the current level through Q2, thus creating a more intense light from LED 33 when the toned voltage sample is viewed. The reason for this is that the bare photoconductor will reflect a higher light level than the toned image. It was recognized that the reflected light intensities exciting the photocell must be kept at a nearly equal level whether viewing a bare sample or a toned sample. The reason for this is to avoid the non-linearities which occur in photocell excitations from reception of different light levels to avoid the non-linearities in circuit response and to guarantee high signal levels whether viewing the bright reference sample or the darker toned sample in order to improve noise immunity. In a system which is designed to be relatively free from variations in component sensitivities, this is an important feature.

Referring now to the circuit of photocell 34, note that OP AMP 65 is connected as a transconductance amplifier. With photocell 34 off only a small dark current flow exists between the output of OP AMP 65 and the negative input. However, when the photocell is excited, the current flow is substantially increased, causing a significant voltage drop across resistors R16 and R17, creating a voltage level at line 66 of perhaps 1 or 2 volts. Zener diode 67 limits the voltage level which can occur at line 66 to 8.5 volts, i.e., a swing of 8.5 volts from the photocell unexcited value. Assuming a photocell excited voltage level of 2 volts at line 66, the change from 0 volts to 2 volts is coupled through capacitor 68 to an integrating circuit comprised of OP AMP 69, capacitor 70, field effect transistor (FET) Q5 and the associated resistances. Under ordinary conditions 16 volts is placed on the input of OP AMP 69 resulting in an output of 16 volts at line 71. When a light source excites the photocell, resulting in a voltage of, for example, 2 volts on line 66, the two-volt swing is coupled by capacitors 68 and 70 to line 71, resulting in a ramping down of the voltage on line 71 from 16 volts to 14 volts. If a bare (reference) sample is being taken the output of OP AMP 69 biases diode 72 to turn on FET Q6 during the bare sample period. Thus the 14 volts on line 71 passes through FET Q6 and is placed on capacitor 73. That voltage is stored until such time as the toned white voltage sample is taken by photocell 34.

When the toned white voltage sample is taken, there should again be a 2-volt potential produced on line 66 if the white voltage is approximately correct. This is true because of the balancing of current flow in photocell 34 regardless of whether a reference sample or a toned sample is being taken (due to the different current levels through LED 33 as explained above). Thus a 2-volt swing is coupled by capacitors 68 and 70 to line 71 resulting in a 2-volt potential, causing the voltage of line 71 to ramp down from 16 to 14 volts. During the toned sample input period FET Q7 is turned on and FET Q6 remains off. Thus the 14 volts present on capacitor 73, that is, the reference voltage, is placed on the positive input of OP AMP 74 and on the negative input of OP AMP 75, while the toned white voltage sample input present on line 71 is connected directly to the negative input of OP AMP 74 and to the positive input of OP AMP 75.

At OP AMP 74, the 14-volt reference signal is placed on the positive input while the 14-volt toned white voltage sample signal is placed on the negative input. Since there is no differential, the output of OP AMP 74 indicates that the white voltage condition is correct and the white image voltage low signal remains off. Similarly, at OP AMP 75, the reference signal is 14 volts on the negative input while the white voltage signal is 14 volts on the positive input, and therefore the white image voltage high signal remains off.

Suppose, however, that various conditions within the machine, for example, aging of the photoconductor or dirt in the illumination/optical system, cause a drop in white voltage. Such a condition causes undesirably high background on a copy. In this instance, the low white voltage results in a voltage lower than 14 volts at the negative input to OP AMP 74. Since the negative input has gone low, the output of OP AMP 74 goes high, indicating that the white voltage is low. The signal may now be used to adjust the means for producing the vector such as the illumination lamp voltage or the developer bias voltage in order to bring the white voltage level at OP AMP 74 back toward 14 volts.

Similarly, if the white voltage level drifts higher than 14 volts, solid color areas will appear faded, too light, or washed out. Such a condition is sensed by OP AMP 75 and an output is provided indicating that white image voltage is too high. Again, voltage to the illumination lamp or any other means which affect image voltage or developer bias voltage can be changed to bring the white vector level back toward its desired level.

Figure 9:
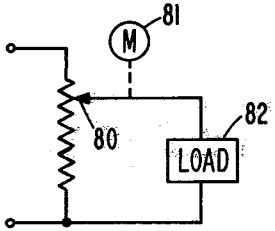
FIG. 9 shows means for adjusting voltage supplied to a load.

Circuit means for adjusting voltage on the developer or changing illumination intensity or other means for changing image voltage in response to the image voltage low or image voltage high signal is necessary for accomplishment of the final step in the process of pinning the vector. Such circuit means can be as simple in concept as the potentiometer circuit shown in FIG. 9 where arm 80 is stepped by motor 81 to provide voltage changes to the load 82 which can be the developer bias or the document lamp. Simple or sophisticated circuit means for gauging the proper amount of movement of arm 80 are well within the skill of the art and do not comprise a part of the invention herein. *IBM Technical Disclosure Bulletin,* Vol. 19, No. 5, pp. 1612, 1613, shows a magnetic brush developer voltage control circuit which is incorporated herein by reference. The image voltage low and high signals would be applied to the pulse width voltage regulator of this circuit in order to change the developer voltage.

Obviously, many variations of the above-described technique can be implemented without departing from the spirit and scope of the invention. For example, it may be desirable to sample white voltage levels for n number of test cycles before adjusting illumination or bias voltage. Also, an analog averaging circuit could be used in place of the digital circuit described herein.

Prior Art

U.S. Pat. No. 3,611,982 provides for periodically sampling a reference voltage on a clean part of the photoconductor outside of the image area of the photoconductor. The voltage is sampled prior to development and used to change development voltage. No attempt is made to sample a representative color test area, develop it, compare it to a reference voltage also obtained from the image area, and then control development voltage. The prior art technique will not provide vector control and will not assure copy quality.

While this invention has been described within the framework of a particular embodiment, i.e., a transfer type machine of the two-cycle type, it can be equally well used in conventional single-cycle machines and it will be understood by those skilled in the art that the foregoing and other changes in form and details may be made without departing from the spirit and scope of the invention.

What is claimed is:

1. A method for maintaining a white, gray or otherwise shaded or colored vector in an electrophotographic machine which includes means for producing said vector, where said vector is the value of the image voltage on the photoconductor produced by imaging a single-shaded surface minus the developer bias voltage, including the steps of:

(1) sensing the single-shaded image to produce a representative image voltage;
(2) sensing the clean photoconductor to produce a representative reference voltage;
(3) obtaining a comparison of the representative image and reference voltages;
(4) periodically repeating steps 1–3 and noting changes in the comparison; and
(5) adjusting said means for producing said vector to at least partially compensate for the change.

2. The method of claim 1 wherein the steps of said method are repeated at intervals during the operation of said machine.

3. The method of claim 1 wherein the reference voltage is obtained by sensing the clean photoconductor within the area of the photoconductor used for document reproductions.

4. A method for maintaining a white, gray or otherwise shaded or colored vector in an electrophotographic machine including means for producing said vector, where said vector is the value of the image voltage on the photoconductor produced by imaging a single-shaded surface minus the developer bias voltage, including the steps of:

(1) developing the image produced by said single-shaded surface;
(2) sensing the reflectivity of the developed single-shaded image to produce a representative image voltage;
(3) sensing the reflectivity of clean photoconductor to produce a representative reference voltage;
(4) obtaining a comparison of the representative voltages;
(5) periodically repeating steps 1–4 and noting changes in the comparison; and
(6) adjusting said means for producing said vector to maintain said value within an acceptable predetermined range.

5. The method of claim 4 wherein the reference voltage is obtained by sensing the clean photoconductor within the area of the photoconductor used for document reproductions.

6. The method of claim 5 wherein the steps of said method are repeated at intervals during the operation of said machine.

7. The method of claim 6 wherein the toner density concentration has been checked and found to be within an acceptable predetermined range prior to each occurrence of step 1.

8. Apparatus for maintaining a white, gray or otherwise shaded or colored vector in an electrophotographic machine where said vector is the value of the image voltage on the photoconductor produced by imaging a single-shaded surface minus the developer bias voltage comprising:

a photoconductor;
a charge corona for laying down a relatively uniform charge on said photoconductor;
an erase lamp means for producing a discharged reference test area in the area of the photoconductor used for document reproductions;
a document lamp means for illuminating a single-shaded original for producing a charged test area in the area of the photoconductor used for document reproductions;
developing means for toning said charged test area;
reflectivity-sensing means for viewing said reference test area and producing a reference voltage therefrom;
said reflectivity means also viewing said charged test area and producing a representative image voltage therefrom;
first circuit means for comparing said reference and representative image voltages; and
second circuit means for adjusting said apparatus for maintaining said vector to maintain the level of said vector within an acceptable predetermined range.

9. In an electrophotographic machine of the transfer type including a photoconductor, a charge corona for producing a relatively uniform charge on the photoconductor, an exposure station for producing a latent image upon the charged photoconductor, a developer with a supply of toner for applying said toner to the latent image whereby a toned image is produced, a transfer corona station to transfer the developed latent image to a receiving member, a preclean corona and an erase lamp for neutralizing and discharging remaining charge on the photoconductor after transfer, a cleaning station for cleaning away residual toner remaining on the photoconductor after transfer, means for maintaining a single-shaded vector where said vector is the value of the image voltage on the photoconductor produced by imaging a single-shaded surface minus the developer bias voltage, and reflectivity-sensing means for viewing said photoconductor, a special machine test cycle including the steps of:

(1) charging the photoconductor;
(2) erasing the charge on the photoconductor except for a test area located in the area of the photoconductor used for document reproductions;
(3) imaging the photoconductive test area from a single-shaded surface;
(4) developing said test area;
(5) producing a representative reference voltage by viewing the erased area with said reflectivity-sensing means;
(6) producing a representative image voltage by viewing the developed test area with said reflectivity-sensing means; and
(7) obtaining a comparison of said representative voltages.

10. The method of claim 9 wherein said test cycle is run upon the completion of copy production.

11. The method of claim 10 wherein said test cycle is run during the middle of a single run by interrupting the production of copies in order to make the test cycle.

12. The method of claim 11 further including the steps of:

noting changes in the comparison of said representative voltages from test cycle to test cycle; and
adjusting said means for maintaining said single-shaded vector in response to said changes.

13. The method of claim 9 wherein a toner density concentration check is performed on said test cycle prior to step 1 and toner concentration is found to be within an acceptable predetermined range.

14. The method of claim 9 wherein said test area and the erased area are produced within the image area used for producing large copies but not used for producing small copies.

15. The method of claim 14 wherein a toner density concentration check is performed on said test cycle prior to step 1 and toner concentration is found to be within an acceptable predetermined range.

* * * * *

UNITED STATES PATENT AND TRADEMARK OFFICE

CERTIFICATE OF CORRECTION

PATENT NO. : 4,179,213

DATED : December 18, 1979

INVENTOR(S) : Carl A. Queener

It is certified that error appears in the above-identified patent and that said Letters Patent are hereby corrected as shown below:

IN THE SPECIFICATION:

Column 7, line 64, delete "low" and insert --high--.
line 68, delete "high" and insert --low--.

Column 8, line 3, delete "drop" and insert --rise--.
line 5, delete "low" and insert --high--.
line 9, delete "low" and insert --high--.
line 14, delete "higher than" and insert --lower--.
line 15, delete "14 volts".
line 18, delete "high" and insert --low--.

IN THE DRAWINGS:

FIG. 6, "IMAGE VOLTAGE LOW" should read --IMAGE VOLTAGE HIGH--.

FIG. 6, "IMAGE VOLTAGE HIGH" should read --IMAGE VOLTAGE LOW--.

Signed and Sealed this

*Tenth* Day of *February 1981*

[SEAL]

*Attest:*

RENE D. TEGTMEYER

*Attesting Officer*

*Acting Commissioner of Patents and Trademarks*